US010704205B2

(12) United States Patent
Liu et al.

(10) Patent No.: US 10,704,205 B2
(45) Date of Patent: Jul. 7, 2020

(54) HOLDDOWN ASSEMBLY FOR RAILWAY RAIL

(71) Applicant: SCHWIHAG AG, Taegerwilen (CH)

(72) Inventors: Jia Liu, Emmering (DE); Stefan Lienhard, Constance (DE); William Locci, Constance (DE); Frank Meyer, Stockach (DE)

(73) Assignee: SCHWIHAG AG, Taegerwilen (CH)

( * ) Notice: Subject to any disclaimer, the term of this patent is extended or adjusted under 35 U.S.C. 154(b) by 343 days.

(21) Appl. No.: 15/687,565

(22) Filed: Aug. 28, 2017

(65) Prior Publication Data

US 2018/0058013 A1 Mar. 1, 2018

(30) Foreign Application Priority Data

Sep. 1, 2016 (DE) ..... 10 2016 216 529

(51) Int. Cl.
*E01B 9/32* (2006.01)
*E01B 9/34* (2006.01)
*E01B 3/16* (2006.01)

(52) U.S. Cl.
CPC ..... *E01B 9/32* (2013.01); *E01B 9/34* (2013.01); *E01B 3/16* (2013.01); *E01B 2205/00* (2013.01)

(58) Field of Classification Search
CPC ..... E01B 9/32; E01B 9/34; E01B 3/16
See application file for complete search history.

(56) References Cited

U.S. PATENT DOCUMENTS 3,387,781 A * 6/1968 Moses ..... E01B 9/28 238/283
3,858,804 A * 1/1975 Hixson ..... E01B 9/02 238/264
4,505,428 A * 3/1985 Matsuo ..... E01B 9/306 238/349
4,632,308 A * 12/1986 Fischer ..... E01B 9/483 238/265
4,802,623 A * 2/1989 Fasterding ..... E01B 3/32 238/44
2008/0105758 A1* 5/2008 Schwiede ..... E01B 9/303 238/349
2010/0301126 A1* 12/2010 Meyer ..... E01B 9/483 238/303

(Continued)

FOREIGN PATENT DOCUMENTS

CH 654362 B 2/1986
CZ 8007718 A3 8/1993

(Continued)

*Primary Examiner* — Jason C Smith
(74) *Attorney, Agent, or Firm* — Andrew Wilford

(57) ABSTRACT

A holddown assembly fastens a railway rail to a transversely extending hollow sleeper formed with a vertically through-going hole. An upwardly projecting lateral brace element is provided on the sleeper offset from the hole, and the assembly has a body fitted between the rail and the brace element and transversely bracing the rail against the brace element. An anchor of the assembly is engaged through the hole, projects upward from the sleeper, is transversely shiftable in the hole, and bears upward on the sleeper. A spring clip is pressed by the anchor down against the rail and presses the rail down against the metal sleeper.

12 Claims, 2 Drawing Sheets

(56) References Cited

U.S. PATENT DOCUMENTS

| | | | | |
|---|---|---|---|---|
| 2013/0056545 | A1* | 3/2013 | Danneberg | E01B 9/18 238/315 |
| 2014/0103132 | A1* | 4/2014 | Lienhard | E01B 9/303 238/283 |
| 2015/0136865 | A1* | 5/2015 | Walter | E01B 2/003 238/345 |
| 2016/0002864 | A1* | 1/2016 | Awi Abalo | E01B 9/46 238/297 |
| 2018/0058013 | A1* | 3/2018 | Liu | E01B 9/32 |

FOREIGN PATENT DOCUMENTS

| | | | |
|---|---|---|---|
| DE | 4116306 | A1 | 11/1992 |
| DE | 4406105 | A | 8/1995 |

* cited by examiner

HOLDDOWN ASSEMBLY FOR RAILWAY RAIL

FIELD OF THE INVENTION

The present invention relates to a holddown assembly for a railway rail.

BACKGROUND OF THE INVENTION

An assembly for holding a railway rail down on a hollow sleeper made of sheet metal is known from CH 654362 where a hook pin engages through an oblong hole in the hollow sleeper, is pulled from below against the hollow sleeper by a positive fit, and presses down via a spring washer to clamp the rail. In such an arrangement, transverse forces that occur during drive operation are transmitted through by a rail guide plate that conducts the transverse displacement forces to the hollow sleeper predominantly via the hook pin at the hole.

DE 44 06 105 describes a rail fastening on two steel beams in which a first pair of pins presses a rail against a ribbed base plate by spring clips, with the ribbed base plate being secured to the steel beams by a second pair of pins without spring clips.

In other known solutions for using steel sleepers, the rails are not mounted directly on the sleeper, but rather on rail-bed plates that are costly to manufacture and must themselves be welded to the sleeper.

OBJECTS OF THE INVENTION

It is therefore an object of the present invention to provide an improved holddown assembly for a railway rail.

Another object is the provision of such an improved holddown assembly for a railway rail that overcomes the above-given disadvantages, in particular that enables a rail to be secured in a simple and durable manner to a metal sleeper while avoiding an unnecessary force effect on the metal sleeper.

SUMMARY OF THE INVENTION

A holddown assembly fastens a railway rail to a transversely extending hollow sleeper formed with a vertically throughgoing hole. An upwardly projecting lateral brace element is provided on the sleeper offset from the hole, and the assembly has a body fitted between the rail and the brace element and transversely bracing the rail against the brace element. An anchor of the assembly is engaged through the hole, projects upward from the sleeper, is transversely shiftable in the hole, and bears upward on the sleeper. A spring clip is pressed by the anchor down against the rail and presses the rail down against the metal sleeper.

By supporting the holddown subassembly on the lateral brace with play for the anchor, the operational transverse forces can be prevented from being transmitted by direct abutment of the anchor on a wall of its mounting hole. This inventive concept of rail fastening makes it possible for the anchor to substantially have the task of fixing the rail in the vertical against the metal sleeper, while transverse forces of the rail occurring during operation are transmitted to the metal sleeper primarily via the holddown subassembly and the lateral brace. In this way, an apportioning of the active forces is achieved that withstands collectively large operating forces during a long service life and prevents the metal sleepers from wearing through. In addition, because the anchor has free play in the hole transversely under operating conditions, supporting of the lateral forces on the edge of the hole is prevented. This reduces the risk of cracking the metal sleeper.

A metal sleeper is preferably understood as being a sleeper made of steel. Aside from the inventive features, the design of the metal sleeper can be of a conventional type, for example in the form of an open or closed hollow sleeper, an I-sleeper, T-sleeper, etc. In the general sense of the invention, a metal sleeper is understood as being any metallic base—including metal plates, for example, that have several rail-fastening points according to the invention, but not known steel Y-sleepers that are composed of several elements and in which two bent steel profiles are welded together or connected by bars on the upper and lower side.

Depending on requirements, different baffle plates made of a dampening material such as plastic, for example, can be provided between the rail and the metal sleeper.

In terms of the invention, a spring clip is any resiliently elastic element that can be loaded with a defined prestress by a tensile elongation to press the rail by the prestress downward toward the metal sleeper. Common spring clips are often prebent from an appropriately dimensioned and resiliently elastic material of round section.

In terms of the invention, an anchor is understood to be a fastener to which tensile force can be applied and that is pressed down on the metal sleeper on the one hand and in turn presses the rail down against the metal sleeper. Examples of preferred anchors in terms of the invention are T-bolts with a thread on an upper end that are held in a form-fitting manner in the metal sleeper. For example, the pin can be pushed with a locking head at a lower end through a slotted hole in the metal sleeper and then rotated in order to establish a positive fit.

In terms of the invention, the transverse direction runs horizontal and transverse to a direction of extension of the rail.

In an advantageous embodiment of the invention, the rail is insulated from the metal sleeper by electrically insulating components. The electrical insulation can be provided for various purposes, for example as a safety mechanism or for reasons relating to signal engineering. The insulating components can be particularly made of a plastic. For example, an insulating sleeve can be fitted around the anchor.

In a generally advantageous manner, the holddown subassembly comprises an angled guide plate for the spring clip. Such an angled guide plate supports the spring clip and guides it during prestressing when the rail is anchored. The angled guide plate can also have a stop for a nut, for example, thereby providing precise prestressing of the spring clip.

In a preferred development, the angled guide plate can be made at least in part of an electrically insulating material. This makes it especially easy to insulate the rail electrically from the metal sleeper.

In a generally advantageous manner, the position of the rail transversely of the metal sleeper is determined by the holddown subassembly. Holddown subassemblies having various widths can be prefabricated for this purpose, for example. Alternatively or in addition, the holddown subassemblies can comprise insertable, laterally acting spacers that are available in various widths and are selected based on requirements.

In order to reduce force peaks and wear in general, the holddown subassembly is elastically deformable transversely. This can be achieved by deliberately provided crimps, material recesses, or the like. A spring constant of the holddown subassembly transversely can be optimized through such measures and adapted to the transverse forces that can be expected during operation.

In a generally preferred embodiment, the metal sleeper can be hollow. Hollow sleepers are especially suited to transmitting high lateral forces into a ballast substructure and lend themselves ideally to combination with the fastening of a rail according to the invention.

To improve the distribution of force, the lateral brace can comprise a bar extending longitudinally of the rail and be detachably connected to the metal sleeper—for prefabrication with adaptation to different track gauges—or non-detachably, for example by welding. Preferably, the longitudinally extending brace body extends substantially over a length of a bearing surface of the rail on the metal sleeper, thereby optimally distributing the force transmission over the width of the sleeper.

In principle, the lateral brace can also comprise recesses or holes in the metal sleeper in which a corresponding formation of the holddown subassembly engages in a positive-fitting or frictional manner. Such arrangements also enable the lateral forces to be introduced into the metal sleeper such that they are distributed over a large width and the metal sleeper is separated from the vertically acting retention force of the anchor.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
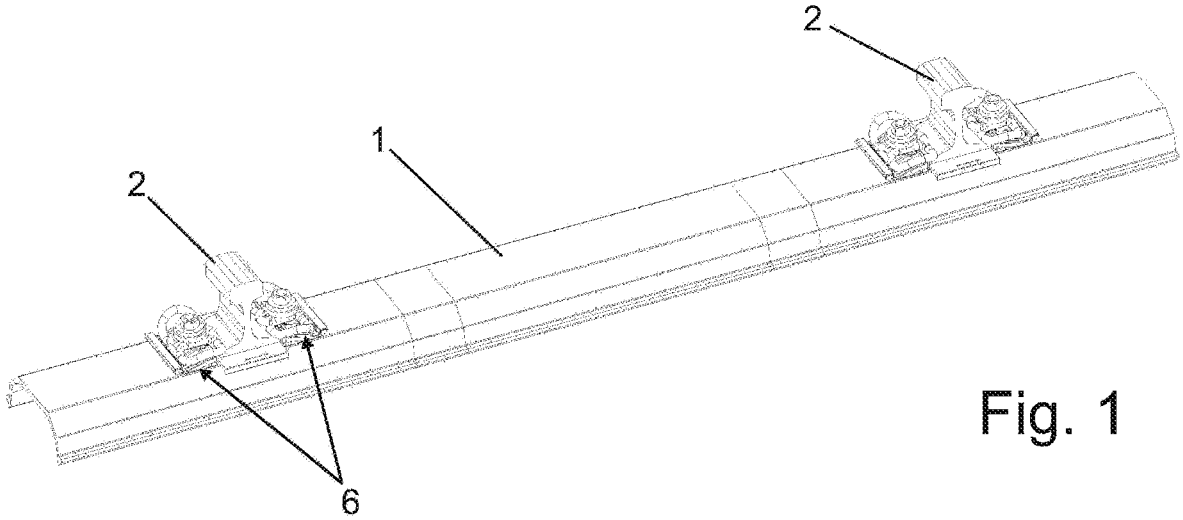
FIG. 1 is an overall perspective view of an assembly according to the invention.
Figure 2:
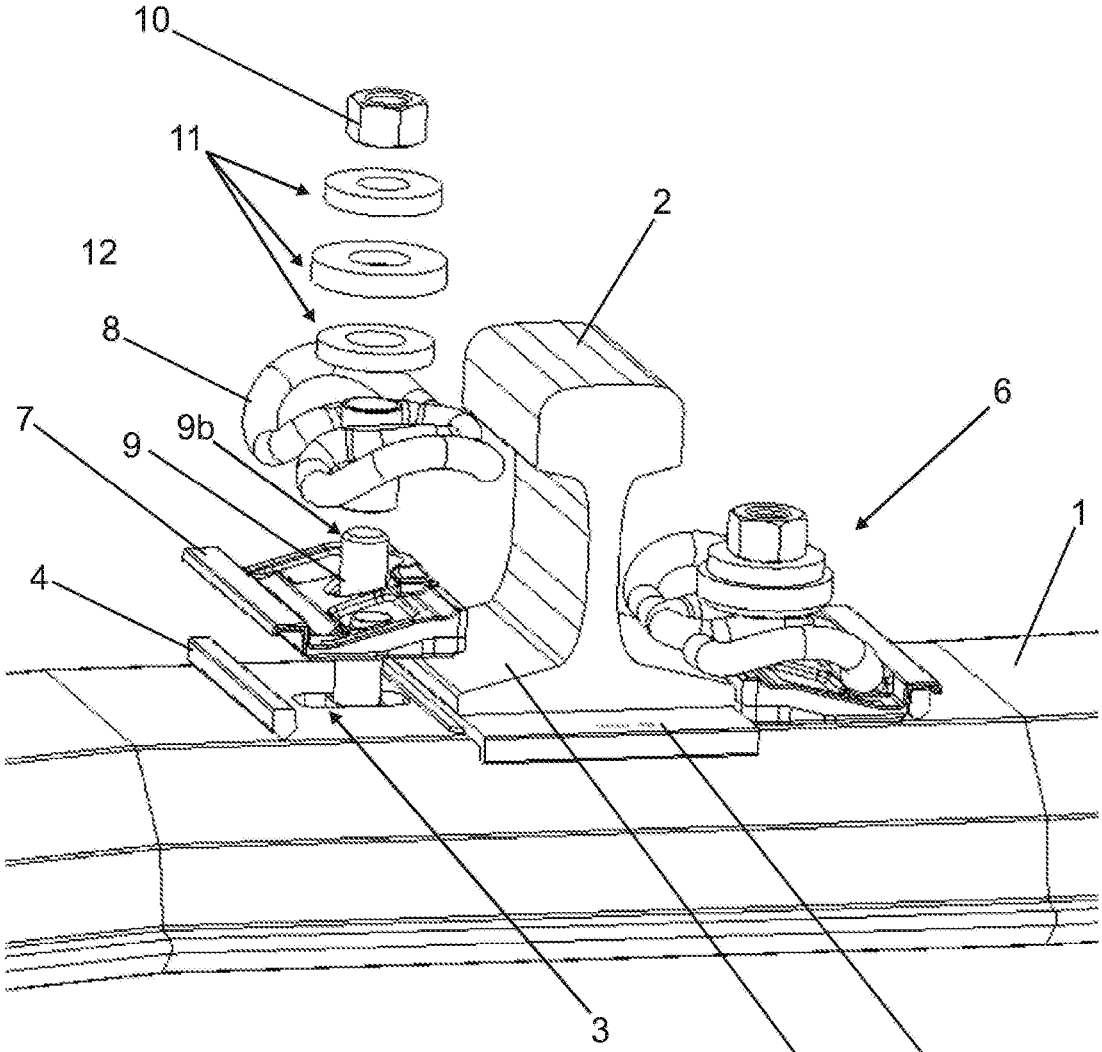
FIG. 2 is an exploded perspective view of the assembly of FIG. 1.
Figure 3:
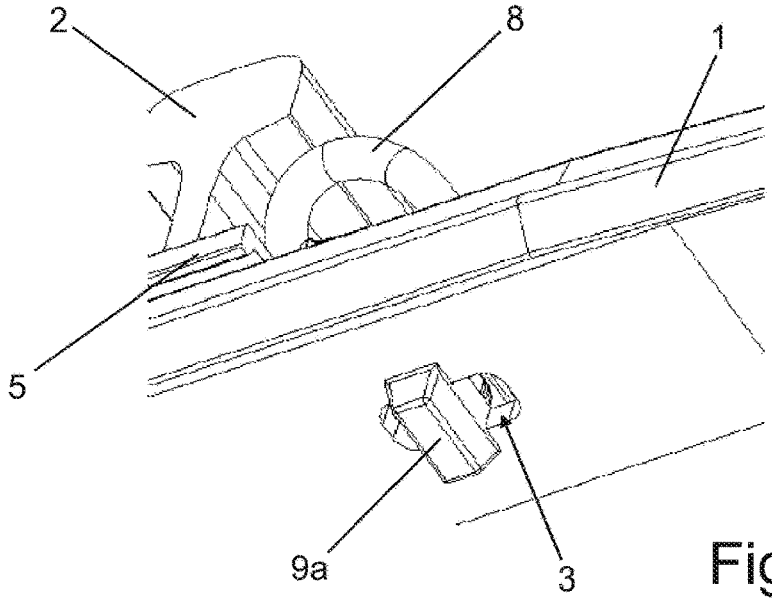
FIG. 3 is a detailed perspective view from below of the assembly of FIG. 1.
Figure 4:
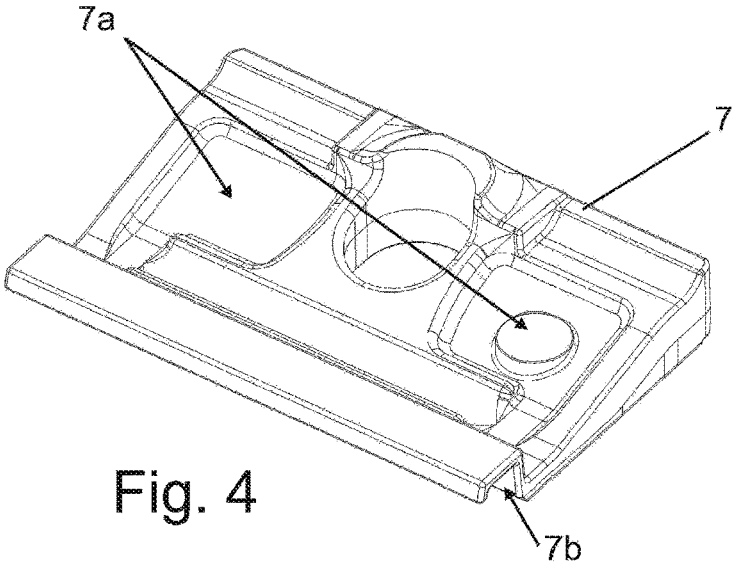
FIG. 4 is a perspective view of an angled guide plate of the assembly from FIG. 1.
Figure 5:
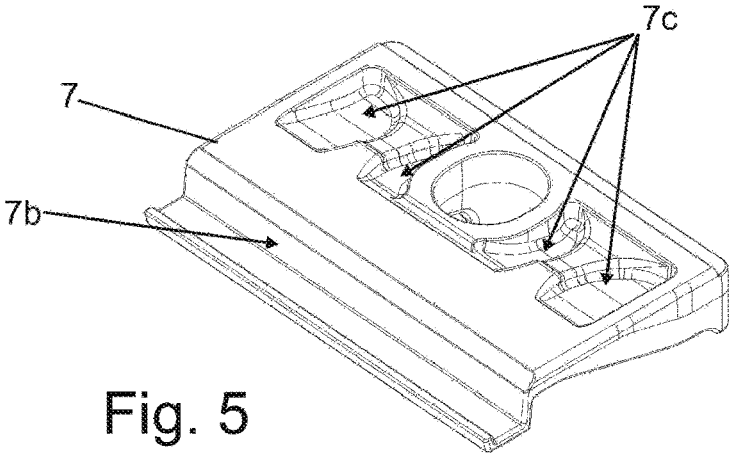
FIG. 5 is the angled guide plate from FIG. 4 from below.

The fastening assembly comprises a metal sleeper 1 that extends in a transverse direction and on which two parallel rails 2 for a railway vehicle are mounted that extend longitudinally and perpendicular to the transverse direction.

In this case, the metal sleeper 1 is hollow and made of appropriately shaped sheet steel. The two rails 2 are secured in a structurally identical manner, so reference will be made below only to the securing of one of the rails.

In order to secure the rail 2 to the metal sleeper 1, two through holes 3 are formed in the steel sleeper that are shaped as slots extending transversely, i.e., orthogonally to the rail. Two lateral brace elements 4 are secured to the upper side of the metal sleeper. The lateral brace elements 4 are configured as simple guide bars that extend longitudinally of the rail. The lateral brace bars 4 extend at least approximately over a length that corresponds to a bearing surface of the rail 2 on the metal sleeper 1.

The holes 3 are between the respective lateral brace bars 4. The rail 2 sits on the metal sleeper 1. In order to provide better damping, a cushion plate 5 is inserted between the rail 2 and the metal sleeper 1 that is made of an elastic material, here plastic. The plate 5 does not assume any functions involving the reinforcement of the metal sleeper, so the rail 2 rests directly on the metal sleeper 1 with regard to the supporting forces.

A holddown subassembly 6 is provided on each side of the rail 1 between the respective lateral brace bar 4 and a rail foot 2*a* of the rail 2. The holddown subassemblies 6 are identically constructed on each side of the rail. Each of the two holddown subassemblies 6 comprises an angled guide plate 7, a spring clip 8, and an anchor 9. The angled guide plate 7 rests on the metal sleeper 1 and guides the resiliently elastic spring clip 8. The spring clip 8 is fitted on one side in recesses 7*a* of the angled guide plate 7 and engages over the rail foot 2*a* from above with the other side.

The anchor 9 is a pin-like rod that has an oblong locking head 9*a* on a lower end and an external thread 9*b* on an upper end. The anchor is inserted with the locking head 9*a* through the respective hole 3 of the metal sleeper 1 and rotated in order to establish a positive fit. The angled guide plate 7, the spring clip 8, and washers 11 are then placed over the anchor, and the spring clip is compressed by a nut 10 that fits with the external thread 9*b*.

The spring clip presses the rail foot 2*a* substantially perpendicularly downward against the metal sleeper 1. The anchor has sufficient play in the slotted hole transversely that transverse forces are not introduced into the metal sleeper 1 as a result of abutment of the anchor in the hole 3.

The holddown subassembly 6 and/or the angled guide plate 7 fills the region between rail foot 2*a* and lateral brace bar 4 with no play, so that transverse forces occurring during operation are transmitted to the lateral brace bars via the holddown subassemblies.

The angled guide plate 7 rests with a bearing edge 7*b* against the lateral brace bar 4, so that the force is distributed over the length of the lateral brace bar. The angled guide plate also extends over the lateral brace bars 4 at the bearing edge 7*b*.

In order to reduce force peaks that occur, the angled guide plate is elastic transversely, with a spring constant being selected in this direction according to the force peaks that are to be expected. For this purpose, weakened portions 7*c* are formed in a targeted manner in the angled guide plate which enable elastic deformation around a corresponding, defined range.

As needed, the assembly also enables the rail 2 to be electrically insulated from the metal sleeper 1, for example in order to set up standard safety circuits in the vicinity of signal boxes or the like.

For this purpose, several components, such as the baffle plate 5, for instance, are made of an insulating material such as plastic. In addition, the anchor is insulated from the spring clip 8, for example by a plastic sleeve 12 that engages around the anchor 9. In this case, at least some of the washers 11 pressing against the spring clip would also need to be made of an insulating material.

Furthermore, the angled guide plate 7 can be made of plastic as well for the purpose of insulation. In other embodiments of an insulated rail, however, the angled guide plate can also be made of metal, and a corresponding isolating plate can be provided between the rail foot 2*a* and the angled guide plate.

In order to enable sufficiently precise positioning of the rail 2 on the metal sleeper transversely, angled guide plates of various widths can be provided. Pairs of angled guide plates are selected and combined that ensure support between the lateral brace bars 4 that is backlash-free overall. The position of the rail 2 relative to the holes 3 can be changed within certain limits. Alternatively, it is also possible to ensure the positioning of the rail transversely by appropriately dimensioned additional spacers.

We claim:

1. An assembly for fastening a railway rail to a transversely extending hollow sleeper formed with a vertically throughgoing hole, the assembly comprising:

an upwardly projecting and longitudinally extending lateral brace bar formed and fixed on the sleeper offset from the hole, the lateral brace bar extending parallel to the rail;

a body fitted between the rail and the brace bar and transversely bracing the rail against the brace bar;

an anchor engaged through the hole, projecting upward from the sleeper, transversely shiftable in the hole, and bearing upward on the sleeper;

a spring clip pressed by the anchor down against the rail and pressing the rail down against the sleeper.

2. The assembly defined in claim 1, further comprising electrical insulation between the rail and the sleeper.

3. The assembly defined in claim 2, wherein the body and spring are electrically conductive and the insulation is between the body, the sleeper, the brace bar, and the fastener and between the fastener and the spring clip.

4. The assembly defined in claim 1, wherein the body is an angled guide plate through which the fastener extends.

5. The assembly defined in claim 1, wherein a position of the rail on the sleeper is determined by s transverse width of the body.

6. The assembly defined in claim 1, wherein the body is transversely elastically deformable.

7. The assembly defined in claim 1, wherein the bar and the body both extend on the sleeper a full width measured longitudinally parallel to the rail.

8. The assembly defined in claim 7, wherein the brace bar, rail, and body are in full contact with each other over the full width of the sleeper.

9. The assembly defined in claim 1, wherein the sleeper is of sheet metal and is hollow.

10. The assembly defined in claim 1, wherein the sleeper is downwardly concave and open.

11. The assembly defined in claim 1, wherein the fastener is formed by a bolt having a T-head engaged underneath the bar and an upwardly projecting externally threaded shaft and by a nut threaded to the shaft and bearing downward on the spring clip.

12. The assembly defined in claim 11, wherein the hole is transversely elongated such that the T-head can be aligned with the hole and pushed through it, then rotated about 90° to lock underneath the sleeper.

* * * * *